US005435696A

United States Patent [19]

Cunning

[11] Patent Number: 5,435,696

[45] Date of Patent: Jul. 25, 1995

[54] TILTABLE OSCILLATING FAN ASSEMBLY

[75] Inventor: Joseph M. Cunning, Cohasset, Mass.

[73] Assignee: Holmes Products Corp.

[21] Appl. No.: 121,933

[22] Filed: Sep. 15, 1993

[51] Int. Cl.[6] ..... F04D 29/60

[52] U.S. Cl. ..... 416/246; 416/100

[58] Field of Search ..... 416/100, 246, 247 R

[56] References Cited

U.S. PATENT DOCUMENTS

| | | | |
|---|---|---|---|
| 1,241,600 | 10/1917 | Aalborg | 416/100 |
| 2,100,923 | 11/1937 | Schmidt et al. | 416/246 |
| 2,183,979 | 12/1939 | Tornberg | 416/100 |
| 4,732,539 | 3/1988 | Shin-Chin | 416/100 |
| 4,850,804 | 7/1989 | Huang | 416/246 |

FOREIGN PATENT DOCUMENTS

| | | | |
|---|---|---|---|
| 156881 | 1/1952 | Australia | 416/100 |
| 622649 | 6/1961 | Canada | 416/246 |
| 41994 | 2/1987 | Japan | 416/246 |
| 12467 | 6/1904 | United Kingdom | 416/246 |

*Primary Examiner*—Edward K. Look
*Assistant Examiner*—James A. Larson
*Attorney, Agent, or Firm*—Kriegsman & Kriegsman

[57] ABSTRACT

A tiltable oscillating fan assembly for use in circulating air. In one embodiment, the fan assembly includes a stand, a fan head and a neck joint. The top of the stand terminates in upwardly extending bifurcated portions. The fan head is rotatably supported on the neck joint. The bottom of the neck joint is shaped to include a rounded portion which is pivotally mounted between the bifurcated portions of the stand. One side of the rounded portion is shaped to include a recessed arc which extends over an angular distance of approximately 90 degrees. An angular boss mounted on the inside surface of one of the bifurcated portions limits the angular movement of the rounded portion relative to the bifurcated portions by abutting the neck joint at opposite ends of the recessed arc. When the boss abuts the neck joint at one end of the recessed arc, the fan head is positioned vertically. When the boss abuts the neck joint the opposite end of the arc, the fan head is positioned horizontally. To secure the fan head at the aforementioned horizontal and vertical positions and at a plurality of positions therebetween, the fan assembly also includes a locking screw which is insertable through the mounting post and the boss and which is used to frictionally engage the arc at a desired position.

6 Claims, 4 Drawing Sheets

TILTABLE OSCILLATING FAN ASSEMBLY

BACKGROUND OF THE INVENTION

The present invention relates generally to fan assemblies and more particularly to tiltable oscillating fan assemblies.

One type of tiltable oscillating fan assembly is disclosed in colony-assigned U.S. Pat. No. 4,732,539 to Shao Shin-Chin, which issued Mar. 22, 1988. The fan assembly disclosed therein includes a neck joint which is mounted for tilting movement back and forth on the top of an upwardly projecting potion of a base. A fan unit is mounted on top of the neck joint for oscillating movement on the neck joint about a vertical axis. A flexible clip element which serves to selectively limit the extent of the tilting movement of the neck joint is attached to the bottom of the neck joint. The clip element has a hooked shaped tip which will strike the front wall of the upwardly projecting portion of the base when the neck joint is tilted down about 20 degrees from the horizontal axis and as a result prevents further downward tilting movement. However, by manually flexing the clip element upward away from the front wall, the neck joint can be tilted further downward so as to place the fan in a collapsed or folded position.

Although the above-described fan assembly is generally satisfactory in circulating air, its fan head cannot be tired to a completely horizontal position. The present inventor regards this as a shortcoming since it is often desirable to position a fan head horizontally (like a ceiling fan), particularly when one wishes to circulate the air of an entire room.

Another type of tiltable oscillating fan assembly is exemplified by the POWER FAN® floor fan (Model No. HAOH-199) marketed by the present assignee, Holmes Products Corp. (Milford, Mass.). The aforementioned fan comprises a bracket-type stand having a pair of upwardly extending members. An annularly-shaped collar is mounted between the upwardly extending members and is adapted for tilting movement between a horizontal position and a vertical position. An oscillating fan unit is disposed within the collar, the fan unit being adapted to oscillate relative to the collar and being coupled to the collar for tilting movement.

SUMMARY OF THE INVENTION

It is an object of the present invention to provide a new and novel tiltable oscillating fan assembly.

It is another object of the present invention to provide a fan assembly as described above whose fan head can be tilted to two or more positions including a horizontal position and a vertical position.

It is still another object of the present invention to provide a fan assembly as described above that can be mass produced and assembled easily.

Additional objects of the invention, as well as features and advantages thereof, will be set forth in part in the description which follows, and in part will be obvious from the description or may be learned by practice of the invention. The objects of the invention also may be realized and attained by means of instrumentalities and combinations particularly pointed out in the appended claims.

In accordance with the purpose of the present invention as broadly set forth herein, a fan assembly constructed according to the teachings of the present invention is provided herein which comprises (a) a stand having an upwardly projecting portion terminating in bifurcated portions; (b) an oscillating fan unit, said oscillating fan unit including a fan head; (c) a neck joint having a downwardly projecting portion pivotally mounted between said bifurcated portions of said stand for movement over a defined angular distance, said oscillating fan unit being mounted on said neck joint, said defined angular distance including a first position in which said fan head is positioned horizontally and a second position in which said fan head is positioned vertically; and (d) a locking screw for securing said neck joint at any one of a variety of selected angular positions including said first position and said second position.

BRIEF DESCRIPTION OF THE DRAWINGS

The accompanying drawings, which are hereby incorporated into and constitute a part of this specification, illustrate the preferred embodiments of the invention and, together with the description, serve to explain the principles of the invention. In the drawings wherein like reference numerals represent like parts.

DETAILED DESCRIPTION OF PREFERRED EMBODIMENTS

Figure 1:
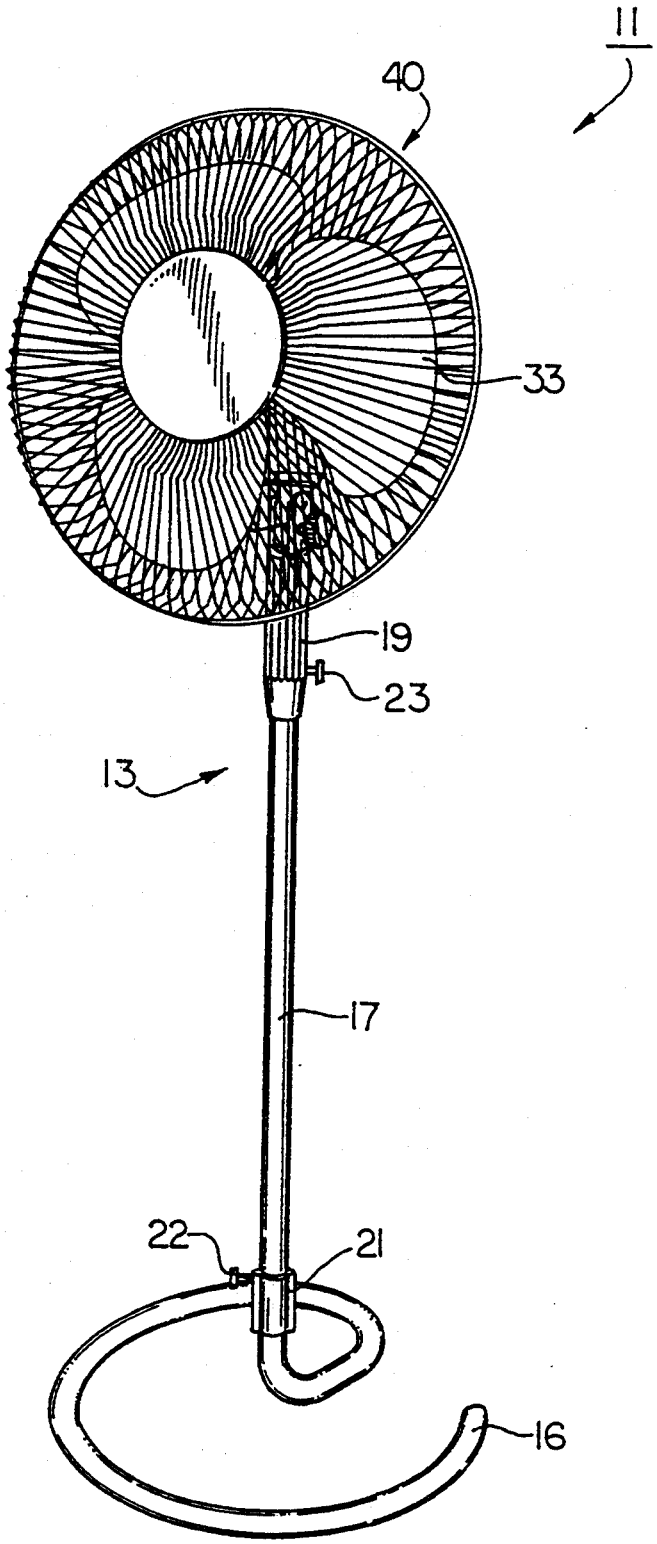
FIG. 1 is a front perspective view of one embodiment of a tiltable oscillating fan assembly constructed according to the teachings of the present invention, the fan head being positioned vertically.
Figure 2:
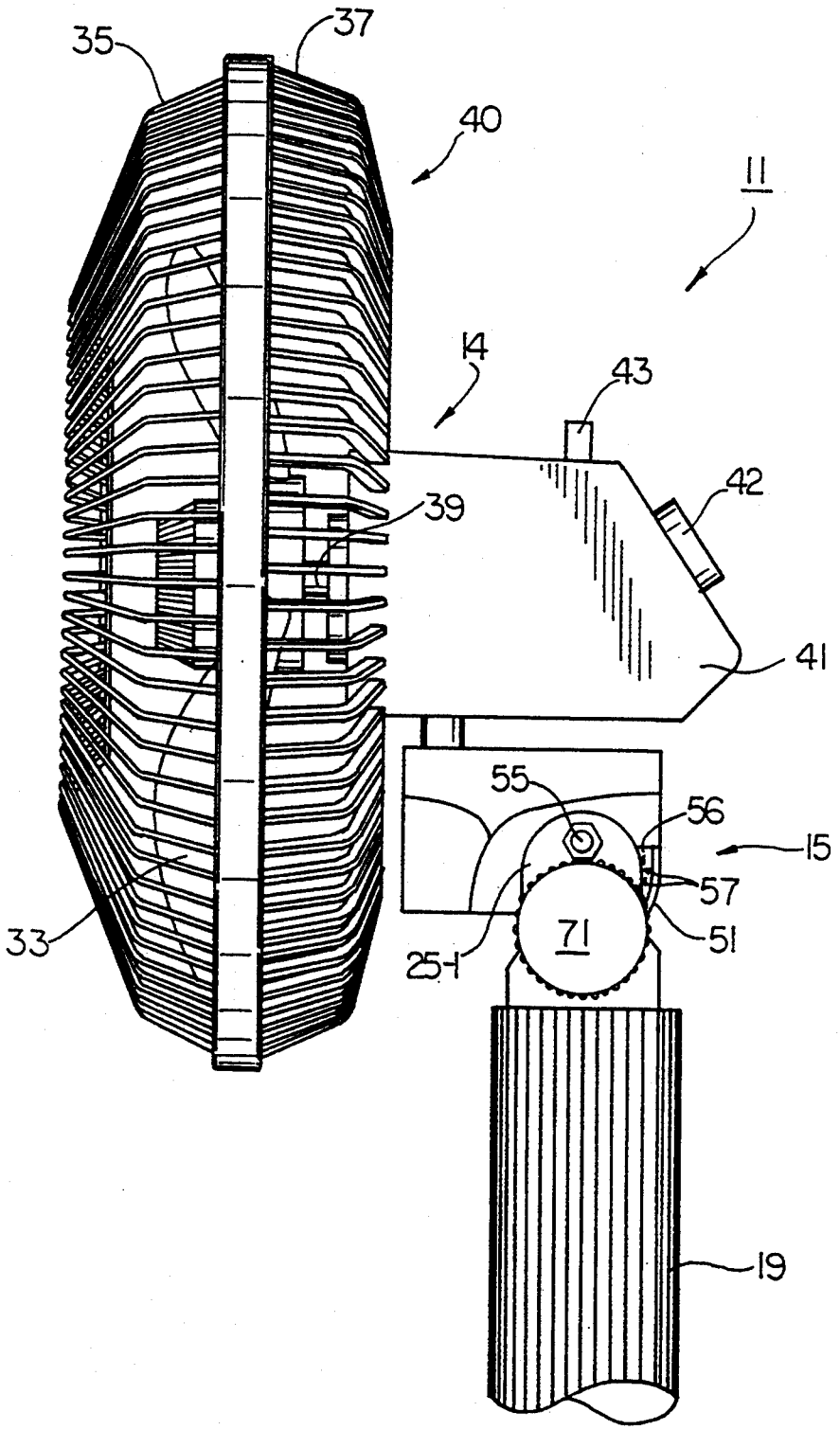
FIG. 2 is an enlarged fragmentary right side view of the tiltable oscillating fan assembly shown in FIG. 1.
Figure 4:
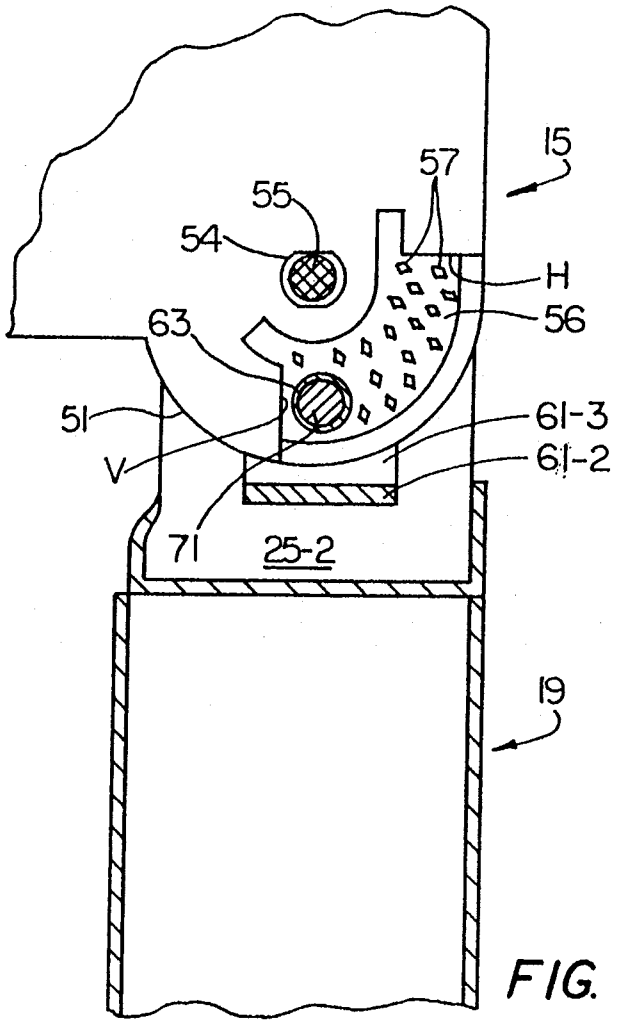
FIG. 4 is an enlarged fragmentary section view of the tiltable oscillating fan assembly shown in FIG. 3 taken along line 1—1
Figure 3:
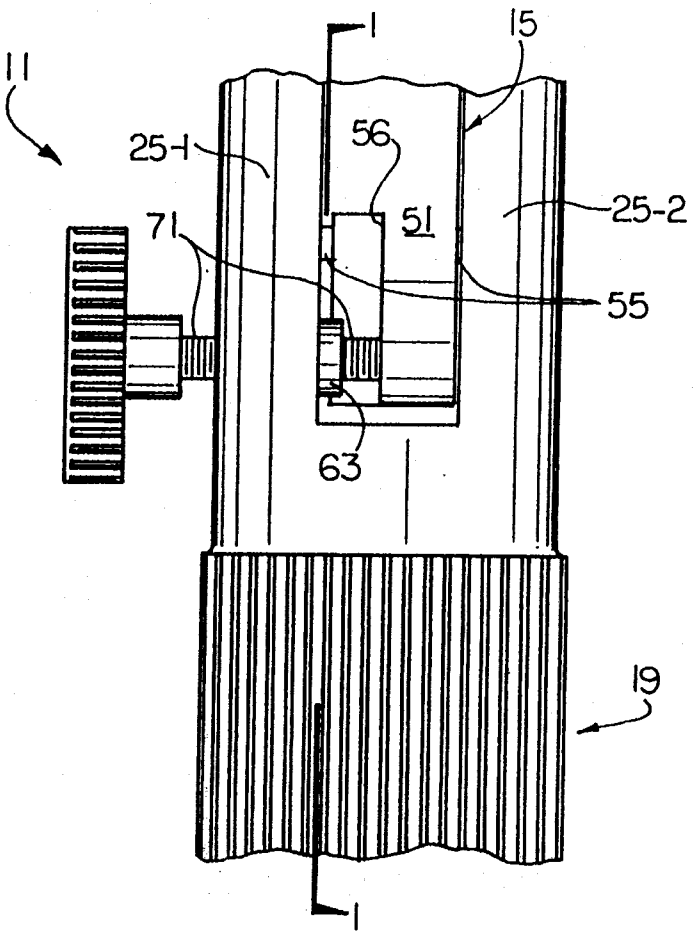
FIG. 3 is an enlarged fragmentary rear view of the tiltable oscillating fan assembly shown in FIG. 1.

Referring now to FIGS. 1 through 4, them am shown various views of one embodiment of a tiltable oscillating fan assembly constructed according to the teachings of the present invention, the tiltable oscillating fan assembly being represented generally by reference numeral 11. Those parts of fan assembly 11 not pertinent to the present invention are not shown or discussed.

Fan assembly 11 includes a floor stand 13, a fan unit 14 and a neck joint 15.

Floor stand 13 comprises a curved base 16, an upwardly extending extender pole 17, and an upwardly extending mounting post 19. Base 16 is coupled to extender pole 17 by a coupling 21 and a screw 22. Extender pole 17 is coupled to mounting post 19 by a screw 23. Although not shown, base 16 could be connected directly to mounting post 19 by disconnecting the ends of extender pole 17 from base 16 and post 19, inserting the upwardly extending portion of base 16 into the bottom of post 19 and tightening screw 23. For reasons to be discussed below, the top of mounting post: 19 terminates in upwardly extending bifurcated portions 25-1 and 25-2.

Fan unit 14 is an oscillating fan unit, the particular electromechanical mechanism for achieving oscillating not being a part of this invention. Fan unit 14 includes a set of fan blades 33 enclosed within a front grill 35 and a rear grill 37. For purposes of the present invention, fan blades 33, front grill 35 and rear grill 37 may be collectively referred to as a "fan head" 40. Fan blades 33 are mounted on a shaft 39 which is connected to the drive shaft of a fan motor (not shown) enclosed within a motor housing 41. Actuation of the fan motor is achieved by means of a rotary switch 42 accessible at the rear of housing 41. Fan unit 14 is rotatably supported on neck joint 15 by conventional means. Actuation of oscillation is achieved by means of a bar 43 which extends through housing 41.

The bottom of neck joint 15 is shaped to include a rounded portion 51. Rounded portion 51 is pivotally mounted between bifurcated portions 25-1 and 25-2 of mounting post 19 by means of a screw 55 inserted through a hole 54 in neck joint 15 and respective holes in bifurcated portions 25. One side of rounded portion 51 is shaped to include a recessed arc 56. Arc 56 has an angular distance of slightly greater than 90 degrees. A plurality of embossments 57 are formed on recessed arc 56.

Figure 5:
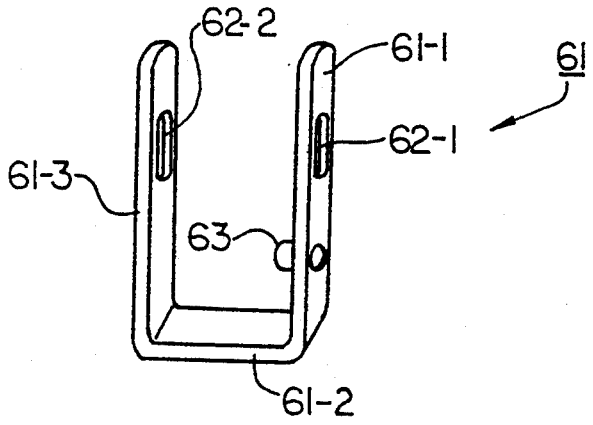
FIG. 5 is an enlarged perspective view of the U-shaped bracket shown in FIG. 4.
Figure 6:
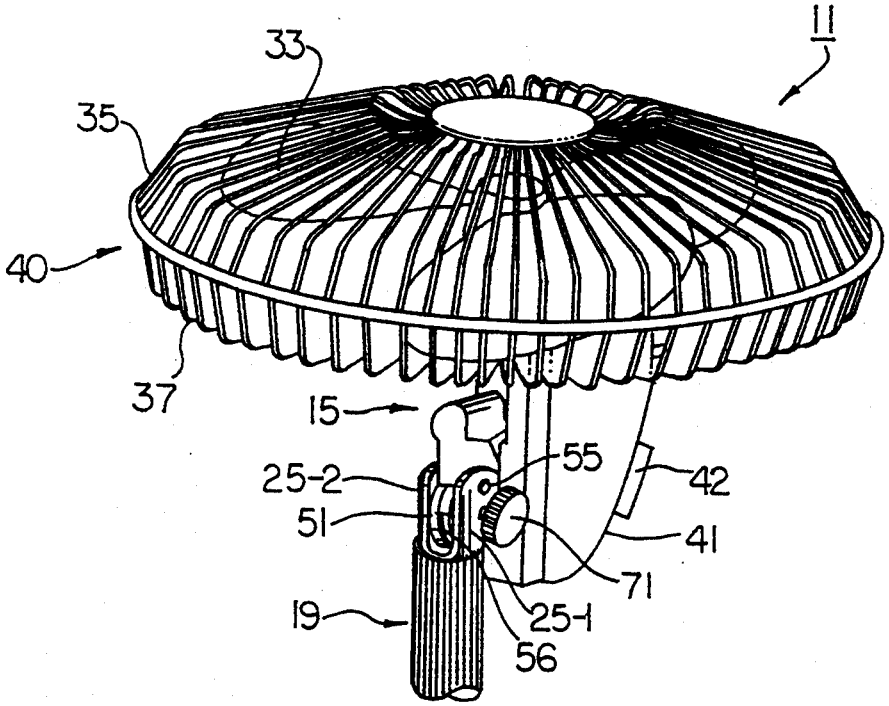
FIG. 6 is an enlarged fragmentary front perspective view of the tiltable oscillating fan assembly shown in FIG. 1, with the fan head positioned horizontally.

A U-shaped bracket 61 (see FIG. 5) is slidably mounted inside the top portion of mounting post 19. Legs 61-1 and: 61-3 of bracket 61 extend longitudinally along the inside surfaces of bifurcate, d portions 25-1 and 25-2. Base 61-2 of bracket 61 extends between bifurcated portions 25-1 and 25-2 at a point below rounded portion 51. Legs 61-1 and 61-3 are provided with respective openings 62-1 and 62-2 through which screw 55 is inserted. Leg 61-1 is also provided with an annular boss 63. Boss 63 serves to limit the angular movement of rounded portion 51 relative to bifurcated portions 25-1 and 25-2 by abutting neck joint 15 at the opposite ends of recessed arc 56. With boss 63 disposed at end V of arc 56, fan head 40 is positioned vertically. With boss 63 disposed at end H of arc 56, fan head 40 is positioned horizontally (see FIG. 6). To secure fan head 40 at the aforementioned horizontal and vertical positions and at a plurality of desired intermediate locations, fan assembly 11 also includes a locking screw 71 insertable through bifurcated portion 25-1 and boss 63 and frictionally engageable with arc 56. Embossments 57 on arc 56 prevent lateral slippage of screw 71 against arc 56 during tightening.

To adjust the angular orientation of fan head 40, locking screw 71 is loosened from recessed arc 56 and neck joint 15 is pivoted until fan head 40 is situated at a desired angular orientation. Locking screw 71 is then tightened, thereby securing fan head 40 at the desired angular orientation.

The embodiment of the present invention is intended to be merely exemplary and those skilled in the art shall be able to make numerous variations and modifications to it without departing from the spirit of the present invention. All such variations and modifications are intended to be within the scope of the present invention as defined in the appended claims.

What is claimed is:

1. A fan assembly comprising:

(a) a stand having an upwardly projecting portion terminating in bifurcated portions;

(b) a fan unit, said fan unit including a fan head;

(c) a neck joint having a downwardly projecting portion pivotally mounted between said bifurcated portions of said stand for movement over a defined angular distance, said fan unit being mounted on said neck joint, said defined angular distance including a first position in which said fan head is positioned horizontally and a second position in which said fan head is positioned vertically;

(d) means for limiting the range of angular movement of said neck joint relative to said stand to between and including said first position and said second position; and (e) means for securing said neck joint at any one of a plurality of selected angular positions including said first position, said second position and a plurality of positions between said first position and said second position.

2. The fan assembly as claimed in claim 1 wherein said fan unit is an oscillating fan unit.

3. A fan assembly comprising:

(a) a stand having a single upwardly projecting portion terminating in bifurcated portions;

(b) an oscillating fan unit, said oscillating fan unit including a fan head;

(c) a neck joint having a downwardly projecting rounded portion, said oscillating fan unit being rotatably supported on said neck joint, said downwardly projecting rounded portion being pivotally mounted between said bifurcated portions of said stand and having on one side thereof a recessed arc extending between a horizontal position and a vertical position;

(d) boss means appropriately positioned on said stand to abut said neck joint at opposite ends of said recessed arc, thereby limiting the range of angular movement of said neck joint relative to said stand to between said horizontal position and said vertical position; and (e) means for fixing said neck joint at a desired angular position relative to said stand, said fixing means comprising a locking screw engageable with said recessed arc.

4. The fan assembly as claimed in claim 3 wherein said stand comprises a base, an extender pole connected to said base and a mounting post connected to said extender pole.

5. The fan assembly as claimed in claim 3 wherein said boss means comprises an annular boss, said locking screw being inserted through said annular boss.

6. The fan assembly as claimed in claim 3 wherein said recessed area is provided with a plurality of embossments, said embossments being used to promote frictional engagement of said locking screw with said recessed area.

* * * * *